US005107150A

United States Patent [19]

Kimura

[11] Patent Number: 5,107,150

[45] Date of Patent: Apr. 21, 1992

[54] ANALOG MULTIPLIER

[75] Inventor: Katsuji Kimura, Tokyo, Japan

[73] Assignee: NEC Corporation, Tokyo, Japan

[21] Appl. No.: 710,033

[22] Filed: May 31, 1991

[30] Foreign Application Priority Data

May 31, 1990 [JP] Japan ..... 2-141923

[51] Int. Cl.[5] ..... G06G 7/12

[52] U.S. Cl. ..... 307/529; 328/144; 328/160

[58] Field of Search ..... 328/160, 142, 143, 144; 307/498, 529

[56] References Cited

U.S. PATENT DOCUMENTS

| | | | |
|---|---|---|---|
| 3,543,288 | 5/1968 | Collings | 328/114 |
| 3,562,553 | 2/1971 | Roth | 328/160 |
| 4,019,118 | 4/1977 | Hardwood | 328/144 |

OTHER PUBLICATIONS

K. H. Norsworthy, B. Sc., "A Simple Electronic Multiplier", Feb. 1954, pp. 72–74.

*Primary Examiner*—Stanley D. Miller
*Assistant Examiner*—Sinh N. Tran
*Attorney, Agent, or Firm*—Whitham & Marheofer

[57] ABSTRACT

A multiplier comprises first and second squaring circuits each including first and second MOS transistors having their sources connected in common and third and fourth MOS transistors having their sources connected in common. The first and third transistors have a first gate W/L ratio and have their drains connected to each other, and the second and fourth transistors have their drains connected to each other and have a second gate W/L ratio different from the first ratio. Gates of the first and fourth transistors are connected to each other, and gates of the second and third transistors are connected to each other. A first input signal is supplied to the gates of the first and fourth transistors of each of the first and second squaring circuits, and a second input signal is supplied, without being inverted, to the gates of the second and third transistors of the first squaring circuit, and without being inverted, to the gates of the second and third transistors of the second squaring circuit. The drains of the first and third transistors of each of the squaring circuits are connected to the second and fourth transistors of the other squaring circuits. A multiplication of the first and second input signals is given by a difference between a current flowing into the drains of the first and third transistors of the first squaring circuits and the drains of the second and fourth transistors of the second squaring circuits, and another current flowing into the drains of the second and fourth transistors of the first squaring circuits and the drains of the first and third transistors of the second squaring circuits.

4 Claims, 6 Drawing Sheets

ANALOG MULTIPLIER

BACKGROUND OF THE INVENTION

1. Field of the Invention

The present invention relates to a multiplier, and more specifically to an analog multiplier for multiplying two analog input signals.

2. Description of Related Art

In the prior art, one typical analog multiplier using a Gilbert's circuit as shown in FIG. 1 has been known.

In the circuit shown in FIG. 1, a first differential circuit is composed of a pair of transistors $M_{21}$ and $M_{22}$ having their sources connected to each other, and a second differential circuit is composed of a pair of transistors $M_{23}$ and $M_{24}$ having their sources connected to each other. Drains of the transistors $M_{21}$ and $M_{23}$ are connected to each other, and drains of the transistors $M_{22}$ and $M_{24}$ are connected to each other. In addition, gates of the transistors $M_{21}$ and $M_{24}$ are connected to each other, and gates of the transistors $M_{22}$ and $M_{23}$ are connected to each other. A first input signal $V_1$ is applied between the gates of the transistors $M_{21}$ and $M_{24}$ and the gates of the transistors $M_{22}$ and $M_{23}$, so that the input signal is applied to the first differential circuit in a non-inverted polarity and to the second differential circuit in an inverted polarity.

The common-connected sources of the transistors $M_{21}$ and $M_{22}$ are connected to a drain of a transistor $M_{25}$, and the common-connected sources of the transistors $M_{23}$ and $M_{24}$ are connected to a drain of a transistor $M_{26}$. Sources of the transistors $M_{25}$ and $M_{26}$ are connected to each other, so that a third differential circuit is formed. The common-connected sources of the transistors $M_{25}$ and $M_{26}$ are connected through a constant current source 21 to ground. A second input signal $V_2$ is applied between the gate of the transistor $M_{25}$ and the gate of the transistor $M_{26}$.

Now, operation of the multiplier as mentioned above will be described.

First, assume that gate widths of the transistors $M_{21}$, $M_{22}$, $M_{23}$, $M_{24}$, $M_{25}$ and $M_{26}$ are $W_{21}$, $W_{22}$, $W_{23}$, $W_{24}$, $W_{25}$ and $W_{26}$, respectively, and gate lengths of the transistors $M_{21}$, $M_{22}$, $M_{23}$, $M_{24}$, $M_{25}$ and $M_{26}$ are $L_{21}$, $L_{22}$, $L_{23}$, $L_{24}$, $L_{25}$ and $L_{26}$, respectively. The gate widths and the gates lengths of the transistors $M_{21}$, $M_{22}$, $M_{23}$, $M_{24}$, $M_{25}$ and $M_{26}$ are set as follows:

$$\frac{W_{21}}{L_{21}} = \frac{W_{22}}{L_{22}} = \frac{W_{23}}{L_{23}} = \frac{W_{24}}{L_{24}} \tag{1}$$

$$\frac{W_{25}}{L_{25}} = \frac{W_{26}}{L_{26}} \tag{2}$$

In addition, by expressing a mobility of the transistors by $\mu_n$ and a thickness of a gate capacitance per unit area by Cox, factors $\alpha_1$ and $\alpha_2$ are defined as follows:

$$\alpha_1 = \mu_n \frac{Cox}{2} \frac{W_{21}}{L_{21}} \tag{3}$$

$$\alpha_2 = \mu_n \frac{Cox}{2} \frac{W_{25}}{L_{25}} \tag{4}$$

Furthermore, assume that a threshold voltage of the transistors $M_{21}$, $M_{22}$, $M_{23}$, $M_{24}$, $M_{25}$ and $M_{26}$ is $V_t$, and gate-to-source voltages of the transistors $M_{21}$, $M_{22}$, $M_{23}$, $M_{24}$, $M_{25}$ and $M_{26}$ are $V_{gs21}$, $V_{gs22}$, $V_{gs23}$, $V_{gs24}$, $V_{gs25}$ and $V_{gs26}$, respectively. Under these conditions, drain currents $I_{d21}$, $I_{d22}$, $I_{d23}$, $I_{d24}$, $I_{25}$ and $I_{d26}$ of the transistors $M_{21}$, $M_{22}$, $M_{23}$, $M_{24}$, $M_{25}$ and $M_{26}$ are expressed as follows:

$$I_{d21} = \alpha_1 (V_{gs21} - V_t)^2 \tag{5}$$

$$I_{d22} = \alpha_1 (V_{gs22} - V_t)^2 \tag{6}$$

$$I_{d23} = \alpha_1 (V_{gs23} - V_t)^2 \tag{7}$$

$$I_{d24} = \alpha_1 (V_{gs24} - V_t)^2 \tag{8}$$

$$I_{d25} = \alpha_1 (V_{gs25} - V_t)^2 \tag{9}$$

$$I_{d26} = \alpha_1 (V_{gs26} - V_t)^2 \tag{10}$$

Here, the drain currents $I_{d21}$, $I_{d22}$, $I_{d23}$, $I_{d24}$, $I_{d25}$ and $I_{d26}$ and the gate-to-source voltages $V_{gs21}$, $V_{gs22}$, $V_{gs23}$, $V_{gs24}$, $V_{gs25}$ and $V_{gs26}$ have the relation expressed by the following equations:

$$I_{d21} + I_{d22} = I_{d25} \tag{11}$$

$$I_{d23} + I_{d24} = I_{d26} \tag{12}$$

$$I_{d25} + I_{d26} = I_0 \tag{13}$$

$$V_{gs21} - V_{gs22} = V_{gs24} - V_{gs23} = V_1 \tag{14}$$

$$V_{gs25} - V_{gs26} = V_2 \tag{15}$$

Thus, the following equation (16) can be derived:

$$I_{d25} - I_{d26} = \alpha_2 V_2 \sqrt{\frac{2I_0}{\alpha_2} - V_2^2} \tag{16}$$

Here, assuming $I_{d25} - I_{d26} = I_{V2}$, the following equations (17) and (18) can be derived from the equations (13) and (16):

$$I_{d25} = \tfrac{1}{2}(I_0 + I_{V2}) \tag{17}$$

$$I_{d26} = \tfrac{1}{2}(I_0 - I_{V2}) \tag{18}$$

On the other hand, $I_{V1}$ is defined by the following equation (19):

$$I_{V1} = \alpha_1 V_1 \sqrt{\frac{I_0}{\alpha_2} - V_1^2} \tag{19}$$

This equation (19) can be modified as follows:

$$V_1^2 = \frac{I_0 \pm \sqrt{I_0^2 - 4I_{V1}^2}}{2\alpha_1} \tag{20}$$

Thus, the following equation (21) can be derived:

$$\begin{aligned} I_1 - I_2 &= (I_{d21} + I_{d23}) - (I_{d22} + I_{d24}) \\ &= (I_{d21} - I_{d22}) - (I_{d24} - I_{d23}) \\ &= \alpha_1 V_1 \sqrt{\frac{2I_{d25}}{\alpha_1} - V_1^2} - \alpha_1 V_1 \sqrt{\frac{2I_{d26}}{\alpha_1} - V_1^2} \end{aligned} \tag{21}$$

-continued $$= \alpha_1 V_1 \left[ \sqrt{\frac{I_0 + I_{V2}}{\alpha_1} - \frac{I_0 \pm \sqrt{I_0^2 - 4I_{V1}^2}}{2\alpha_1}} - \sqrt{\frac{I_0 - I_{V2}}{\alpha_1} - \frac{I_0 \pm \sqrt{I_0^2 - 4I_{V1}^2}}{2\alpha_1}} \right]$$

$$= \frac{1}{2} \sqrt{I_0 \pm \sqrt{I_0^2 - 4I_{V1}^2}} \left[ \sqrt{I_0 + 2I_{V2} \mp \sqrt{I_0^2 - 4I_{V1}^2}} - \sqrt{I_0 - 2I_{V2} \mp \sqrt{I_0^2 - 4I_{V1}^2}} \right]$$

$$= \sqrt{I_{V1}^2 + \frac{1}{2} I_{V2} \left\{ I_0 \pm \sqrt{I_0^2 - 4I_{V1}^2} \right\}} - \sqrt{I_{V1} - \frac{1}{2} I_{V2} \left\{ I_0 \pm \sqrt{I_0^2 - 4I_{V1}^2} \right\}}$$

$$= I_{V1} \left[ \sqrt{1 + \frac{1}{2} \frac{I_{V2}}{I_{V1}^2} \left\{ I_0 \pm \sqrt{I_0^2 - 4I_{V1}^2} \right\}} - \sqrt{1 - \frac{1}{2} \frac{I_{V2}}{I_{V1}^2} \left\{ I_0 \pm \sqrt{I_0^2 - 4I_{V1}^2} \right\}} \right]$$

This equation (21) can be simplified as follows:

First, functions f(x), g(x) and h(x) of "x" can be defined as follows:

$$f(x) = \sqrt{1 + ax} \tag{22}$$

$$g(x) = \sqrt{1 - ax} \tag{23}$$

$$h(x) = f(x) - g(x) \tag{24}$$

The equation (24) can be developed into the form of a series:

$$h(x) = h(0) + \frac{x}{1!} h'(0) + \frac{x^2}{2!} h''(0) + \ldots \tag{25}$$

$$= \{f(0) - g(0)\} + \frac{x}{1!} \{f'(0) - g'(0)\} + \frac{x^2}{2!} \{f''(0) - g''(0)\} + \ldots$$

Here, f'(0), f''(0), . . . and g'(0), g''(0), . . . can be respectively obtained as follows:

$$f'(x) = \frac{1}{2} \frac{a}{\sqrt{1 + ax}} \tag{26}$$

$$\therefore f'(0) = \frac{a}{2}$$

$$f''(x) = -\frac{1}{4} \frac{a^2}{(1 + ax)\sqrt{1 + ax}} \tag{27}$$

$$\therefore f''(0) = -\frac{a^2}{4}$$

$$g'(x) = -\frac{1}{2} \frac{a}{\sqrt{1 - ax}} \tag{28}$$

$$\therefore g'(0) = -\frac{a}{2}$$

$$g''(x) = -\frac{1}{4} \frac{a^2}{(1 - ax)\sqrt{1 - ax}} \tag{29}$$

$$\therefore g''(0) = -\frac{a^2}{4}$$

In addition, since $$f(0) = g(0) = 1,\ h(0) = 0 \tag{30}$$

As a result, the equation (25) can be expressed as follows:

$$h(x) = ax + \ldots \tag{31}$$

Accordingly, similarly to the above, the equation (21) can be expressed as the following equation (32):

$$I_1 - I_2 = I_{V1} I_{V2} \cdot \frac{1}{2} \frac{I_{V2}}{I_{V1}^2} \left\{ I_0 \pm \sqrt{I_0 - 4I_{V1}^2} \right\} + \ldots \tag{32}$$

On the other hand, by referring to the equations (19) and (20), the equation (32) can be modified as the following equation (33):

$$I_1 - I_2 = I_{V1} \cdot I_{V2} \frac{2}{\alpha_1 \left( \frac{I_0}{\alpha_1} - V_1^2 \right)} + \ldots \tag{33}$$

Here, if the second and succeeding items (not shown) in the equation (33) are ignored, and if it is assumed that since $V_1$ is very small, $V_1^2 \approx 0$, the equation (33) can be simplified as follows:

$$I_1 - I_2 \approx \frac{2}{I_0} \cdot I_{V1} \cdot I_{V2} \tag{34}$$

Here, $I_{V1}$ corresponds to a differential output current (transfer curve) of the differential amplifier driven with a half (Io/2) of the constant current Io so as to respond to the input voltage $V_1$, and $I_{V2}$ corresponds to a differential output current (transfer curve) of the differential amplifier driven with a half (Io/2) of the constant current Io so as to respond to the input voltage $V_2$. The transfer curve of the differential amplifier can be regarded to be linear if the input voltage is small. Therefore, a multiplication characteristics can be obtained from the equation (34) in a range in which the input voltages $V_1$ and $V_2$ are small.

In addition, it will be apparent from the equation (33) that a voltage range allowing the multiplier to have a good linearity is narrower in the input voltage $V_1$ than in input voltage $V_2$. Furthermore, if the multiplier is composed of transistors having the same size, the operating ranges of the two input voltages $V_1$ and $V_2$ have a relation of $$V_1 = V_2/\sqrt{2}\ .$$

If the equation (33) is further developed in the form of a series, the following can be obtained:

$$\begin{aligned} I_1 - I_2 &= I_{V1} \cdot I_{V2} \cdot \frac{2}{I_0}\left\{1 + \frac{\alpha_1}{I_0} V_1^2 + \frac{\alpha_1^2}{I_0^2} V_1^4 + \dots\right\} \\ &= \sqrt{\alpha_1 I_1 V_1}\left\{1 + \frac{\alpha_1}{2I_0} V_1^2 - \frac{\alpha_1^2}{4I_0^2} V_1^4 + \dots\right\}\times \\ &\quad \sqrt{2\alpha_2 I_0 V_2}\left\{1 + \frac{\alpha_2}{4I_0} V_2^2 - \frac{\alpha_2^2}{16I_0^2} V_2^4 + \dots\right\}\times \\ &\quad \frac{2}{I_0}\left\{1 + \frac{\alpha_1}{I_0} V_1^2 + \frac{\alpha_1^2}{I_0^2} V_1^4 + \dots\right\} \\ &= 2\sqrt{2\alpha_1\alpha_2 V_1}\left\{1 + \frac{\alpha_1}{I_0} V_1^2 + \frac{\alpha_1^2}{4I_0} V_1^4 + \dots\right\}\times \\ &\quad V_2\left\{1 - \frac{\alpha_2}{4I_0} V_2^2 - \frac{\alpha_2^2}{16I_0^2} V_2^4 + \dots\right\} \end{aligned} \tag{35}$$

Here, if all of items including a second-order and higher orders of the input voltages $V_1$ and $V_2$ are neglected, the equation (35) can be expressed as the following equation (36):

$$I_1 - I_2 \approx 2\sqrt{2\alpha_1\alpha_2} \cdot V_1 \cdot V_2 \tag{36}$$

Therefore, this multiplier can give the result of multiplication of the input voltages $V_1$ and $V_2$ in the form of $I_1 - I_2$.

Referring to FIG. 2, there is shown a circuit diagram of another conventional multiplier, which was disclosed in "A Four-Quadrant MOS Analog Multiplier", Jesus Pena-Finol et al, 1987, IEEE International Solid-State cct, Conf. THPM17.4.

A first input voltage $V_1$ is applied between gates of input transistors $M_{31}$ and $M_{32}$ having their sources connected to each other, and the common-connected sources of the transistors $M_{31}$ and $M_{32}$ are connected to a low voltage $V_{SS}$ through a transistor $M_{55}$ acting as a constant current source. Drains of the transistors $M_{31}$ and $M_{32}$ are connected to a high voltage $V_{DD}$ through transistors $M_{35}$ and $M_{36}$, respectively.

A second input voltage $V_2$ is applied between gates of input transistors $M_{33}$ and $M_{34}$ having their sources connected to each other, and the common-connected sources of the transistors $M_{33}$ and $M_{34}$ are connected to the low voltage $V_{SS}$ through a transistor $M_{54}$ acting as a constant current source. Drains of the transistors $M_{33}$ and $M_{34}$ are connected to the high voltage $V_{DD}$ through transistors $M_{37}$ and $M_{38}$, respectively. A gate of the transistor $M_{37}$ is connected to a drain of the transistor $M_{37}$ itself and a gate of the transistor $M_{38}$ is connected to a drain of the transistor $M_{38}$ itself. Sources of the transistors $M_{37}$ and $M_{38}$ are connected to gates of the transistors $M_{35}$ and $M_{36}$, respectively. The above mentioned transistors constitute a first differential input summing circuit.

Furthermore, the first input voltage $V_1$ is also applied between gates of input transistors $M_{41}$ and $M_{42}$ having their sources connected to each other, and the common-connected sources of the transistors $M_{41}$ and $M_{42}$ are connected to the low voltage $V_{SS}$ through a transistor $M_{51}$ acting as a constant current source. Drains of the transistors $M_{41}$ and $M_{42}$ are connected to the high voltage $V_{DD}$ through transistors $M_{45}$ and $M_{46}$, respectively. In addition, there is provided a pair of transistors $M_{43}$ and $M_{44}$ having their sources connected to each other. The common-connected sources of the transistors $M_{43}$ and $M_{44}$ are connected to the low voltage $V_{SS}$ through a transistor $M_{52}$ acting as a constant current source. Drains of the transistors $M_{43}$ and $M_{44}$ are connected to the high voltage $V_{DD}$, respectively, through transistors $M_{47}$ and $M_{48}$ connected in the form of a load in such a manner that a gate of the transistor $M_{47}$ is connected to a drain of the transistor $M_{47}$ itself and a gate of the transistor $M_{48}$ is connected to a drain of the transistor $M_{48}$ itself. Sources of the transistors $M_{47}$ and $M_{48}$ are connected to gates of the transistors $M_{45}$ and $M_{46}$, respectively. The above mentioned transistors constitute a second differential input summing circuit.

The second input voltage $V_2$ is inverted by a differential circuit composed of transistors $M_{59}$, $M_{60}$, $M_{61}$, $M_{62}$ and $M_{63}$ connected as shown. Outputs of this differential circuit are applied as a second input for the second differential input summing circuit.

Thus, the first differential input summing circuit receives the input voltages $V_1$ and $V_2$, and outputs $(V_1+V_2)$. On the other hand, the second differential input summing circuit receives the input voltages $V_1$ and $-V_2$, and outputs $(V_1-V_2)$.

These outputs of the first and second differential input summing circuits are supplied to a double differential squaring circuit composed of the transistors $M_{39}$, $M_{40}$, $M_{49}$ and $M_{50}$ and resistors $R_{L11}$ and $R_{L12}$.

An output $V_0$ of this double differential squaring circuit is expressed by the following equation (37):

$$\begin{aligned} V_0 &= K[(V_1 + V_2)^2 - (V_1 - V_2)^2] \\ &= \mu_n \frac{C_{ox}}{2} (W/L)_3 \frac{(W/L)_1}{(W/L)_2} V_1 \cdot V_2 \end{aligned} \tag{37}$$

where $(W/L)_1$ is a ratio of a gate width to a gate length in the transistors $M_{31}$ to $M_{34}$ and $M_{42}$ to $M_{44}$;

$(W/L)_2$ is a ratio of a gate width to a gate length in the transistors $M_{35}$ to $M_{38}$ and $M_{45}$ to $M_{48}$;

$(W/L)_3$ is a ratio of a gate width to a gate length in the transistors $M_{39}$, $M_{40}$, $M_{49}$ and $M_{50}$.

It will be seen from the equation (37) that a result of multiplication between the input voltages $V_1$ and $V_2$ can be obtained from the circuit shown in FIG. 2.

The above mentioned conventional multipliers have the following disadvantages:

The multiplier using the Gilbert circuit as shown in FIG. 1 is disadvantageous in that the linearity to the first input voltage $V_1$ is not so good, as seen from the equation (33).

Turning to FIG. 3, there is shown a graph illustrating the result of simulation of the characteristics of the multiplier shown in FIG. 1. This simulation was made under a condition in which a processing condition is Tox=320 Å (Tox is gate oxide thickness) and W/L=50 μm/5 μm. The result of simulation shows that the linearity can be obtained in a range of $-0.2\ V<V_1<0.2\ V$.

In the multiplier shown in FIG. 2, the differential input summing circuits are not so good in linearity, because of unbalance in circuit structure between the differential input summing circuits corresponding to the input voltages $V_1$ and $V_2$, respectively. In addition, a range of the double differential squaring circuit having a square-law characteristics is determined by a circuit structure, and is limited to an extent of $-0.5\ V<V_1$, $V_2<0.5\ V$.

SUMMARY OF THE INVENTION

Accordingly, it is an object of the present invention to provide a multiplier which has overcome the above mentioned defect of the conventional one.

Another object of the present invention is to provide a multiplier having an excellent linearity and an enlarged range of the multiplication characteristics.

The above and other objects of the present invention are achieved in accordance with the present invention by a multiplier comprising:

a first squaring circuit including first and second transistors having a first gate width-to-gate length ratio and having their drains connected to each other, and third and fourth transistors having their drains connected to each other and having a second gate width-to-gate length ratio different from the first gate width-to-gate length ratio, gates of the first and fourth transistors being connected to each other and connected in common to receive a first input signal, and gates of the second and third transistors being connected to each other and connected in common to receive an inverted signal of a second input signal, sources of the first and third transistors being connected to each other and sources of the second and fourth transistors being connected to each other, so that two sets of unbalanced differential circuits are formed, and a squared value of a difference between the first input signal and the inverted signal of the second input signal is outputted;

a second squaring circuit including fifth and sixth transistors having a third gate width-to-gate length ratio and having their drains connected to each other, and seventh and eighth transistors having their drains connected to each other and having a fourth gate width-to-gate length ratio different from the third gate width-to-gate length ratio, gates of the fifth and eighth transistors being connected to each other and connected in common to receive the first input signal, and gates of the sixth and seventh transistors being connected to each other and connected in common to receive the second input signal, sources of the fifth and seventh transistors being connected to each other and sources of the sixth and eighth transistors being connected to each other, so that two sets of unbalanced differential circuits are formed, and a squared value of a difference between the first input signal and the second input signal is outputted; and a subtracting circuit receiving the outputs of the first and second squaring circuit for subtracting the output of the second squaring circuit from the output of the first squaring circuit.

Here, assuming that the first input signal is $V_1$ and the second input signal is $V_2$, the first squaring circuit outputs $(V_1+V_2)^2$, and the second squaring circuit outputs $(V_1-V_2)^2$. Therefore, the subtracting circuit outputs 4 $V_1V_2$ corresponding to a multiplied value between the first and second signals.

The above and other objects, features and advantages of the present invention will be apparent from the following description of preferred embodiments of the invention with reference to the accompanying drawings.

DESCRIPTION OF THE PREFERRED EMBODIMENTS

Figure 1:
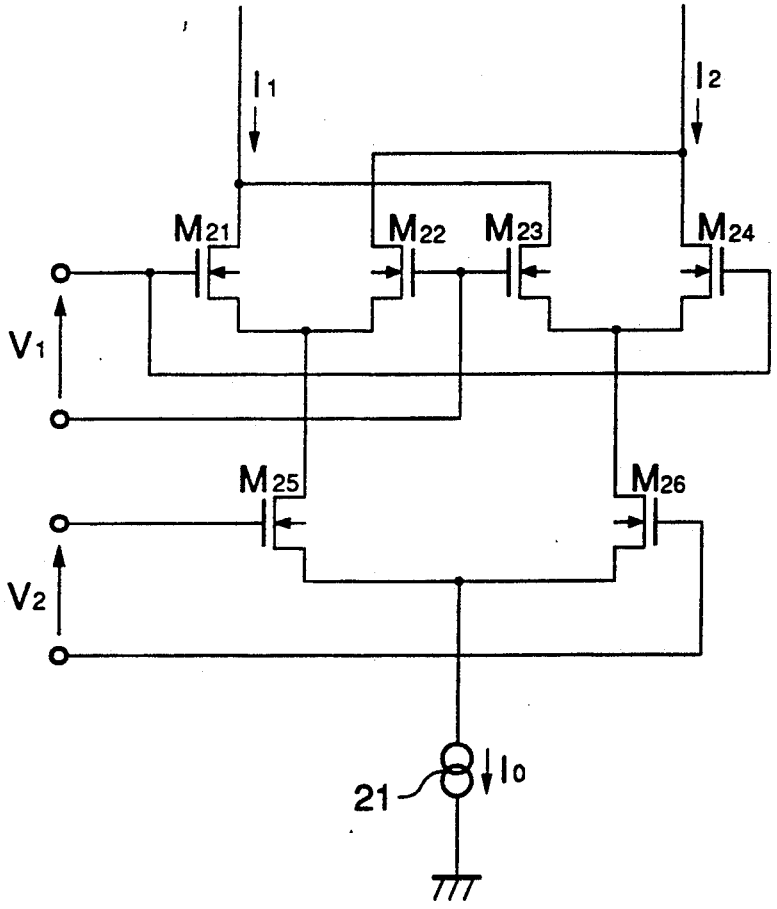
FIGURE 1 PRIOR ART
FIG. 1 is a circuit diagram of one typical analog multiplier using a Gilbert's circuit.
Figure 2:
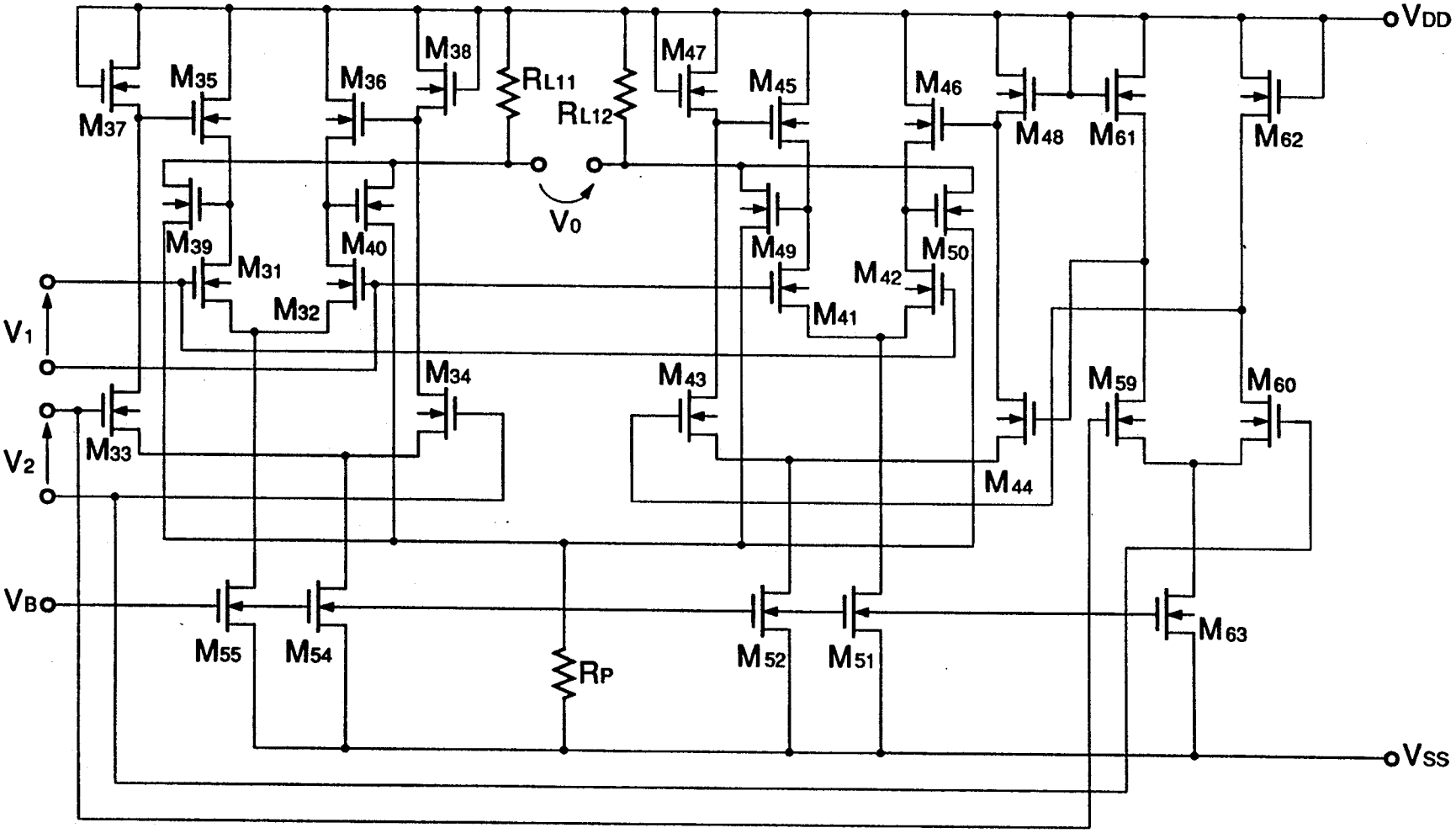
FIGURE 2 PRIOR ART
FIG. 2 is a circuit diagram of another conventional multiplier.
Figure 3:
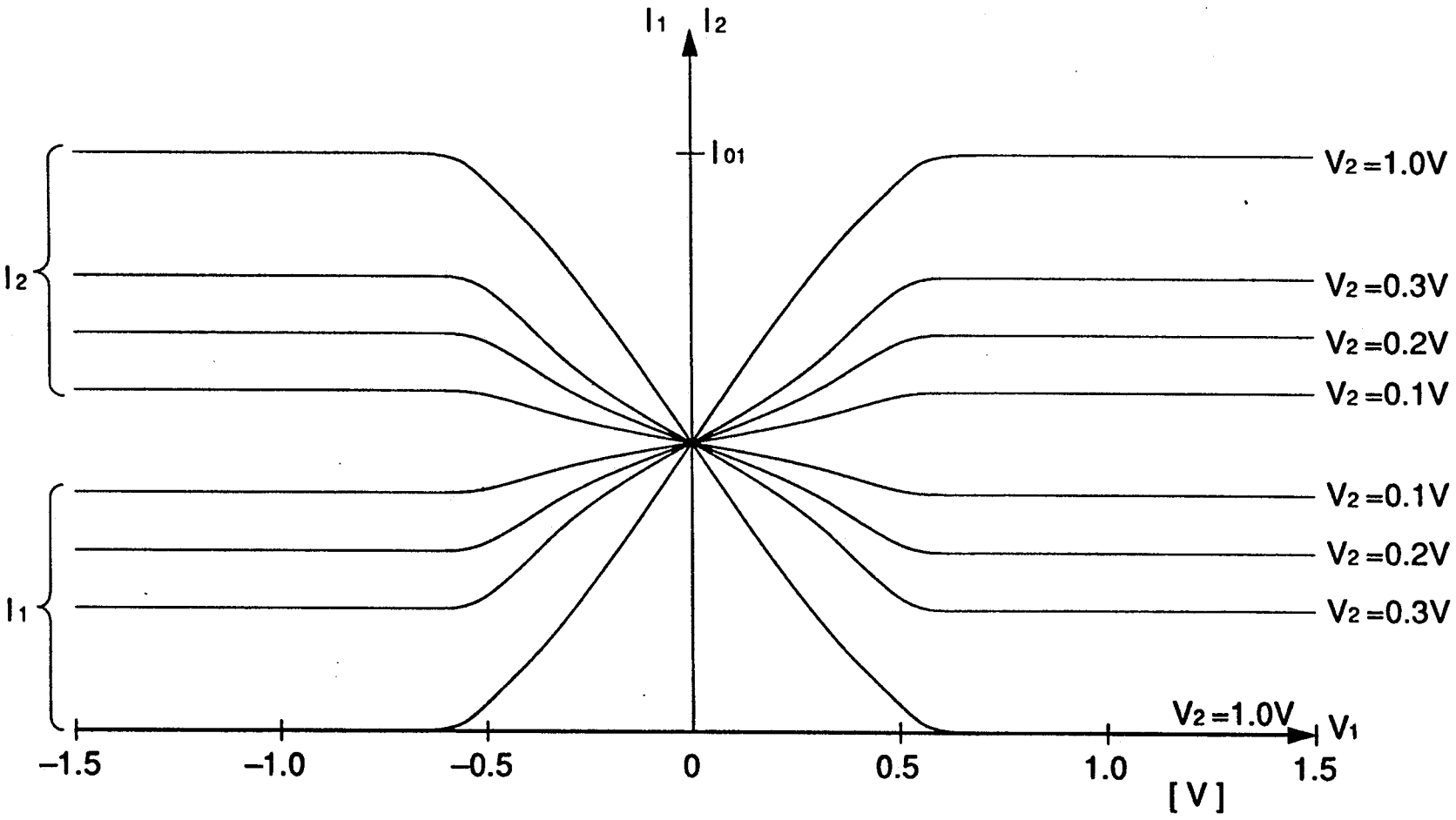
FIGURE 3 PRIOR ART
FIG. 3 is shown a graph illustrating the result of simulation of the characteristics of the multiplier shown in FIG. 1.
Figure 4:
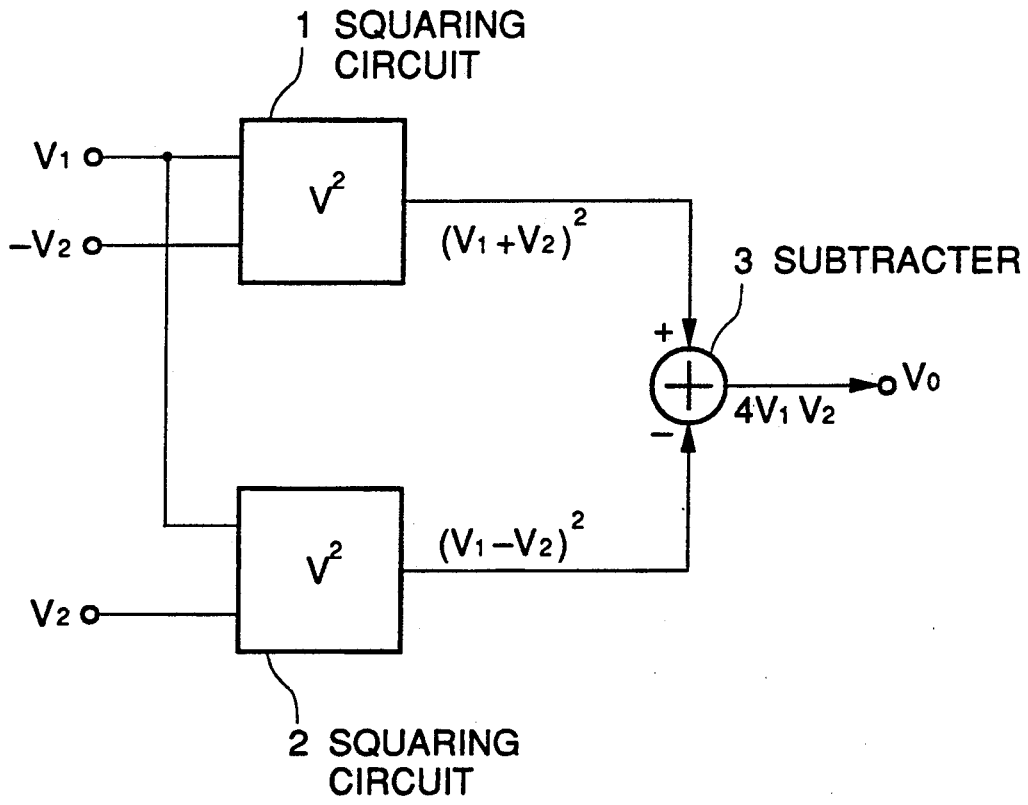
FIG. 4 is a block diagram of the analog multiplier in accordance with the present invention.

Referring to FIG. 4, there is shown a block diagram of the analog multiplier in accordance with the present invention.

The shown multiplier includes first and second squaring circuits 1 and 2 and a subtracting circuit for obtaining a difference between outputs of the squaring circuits 1 and 2.

Each of the squaring circuits 1 and 2 includes first and second pairs of unbalanced differential circuits each of which is composed of a pair of transistors having different ratios of a gate width (W) to a gate length (L) and having their sources connected to each other, a gate of each transistor of the first unbalanced differential circuit being connected to a gate of a transistor which is included in the second differential circuit and which has the W/L ratio different from that of that transistor of the first unbalanced differential circuit, and a drain of each transistor of the first unbalanced differential circuit being connected to a drain of a transistor which is included in the second differential circuit and which has the same W/L ratio different as that of that transistor of the first unbalanced differential circuit.

The first squaring circuit 1 is connected to receive, as a differential input signal, a first input voltage $V_1$, and an inverted voltage $-V_2$ of a second input voltage $V_2$. On the other hand, the second squaring circuit 2 is connected to receive the first input voltage $V_1$ and the second input voltage $V_2$ as a differential input signal. The output of the first and second squaring circuits 1 and 2 are connected to the subtracting circuit 3, which generates an output voltage $V_0$ indicative of the result of multiplication.

With the above mentioned arrangement, the first and second squaring circuits 1 and 2 receive differential input signals $(V_1+V_2)$ and $(V_1-V_2)$, respectively, and therefore, output $(V_1+V_2)^2$ and $(V_1-V_2)^2$, respectively. Accordingly, the outputs of the squaring circuits 1 and 2 are subtracted by means of the subtracting circuit 3, so that the result of multiplication as shown in the following equation (41) can be obtained:

$$V_0=(V_1+V_2)^2-(V_1-V_2)^2=4V_1V_2 \quad (41)$$

Figure 5:
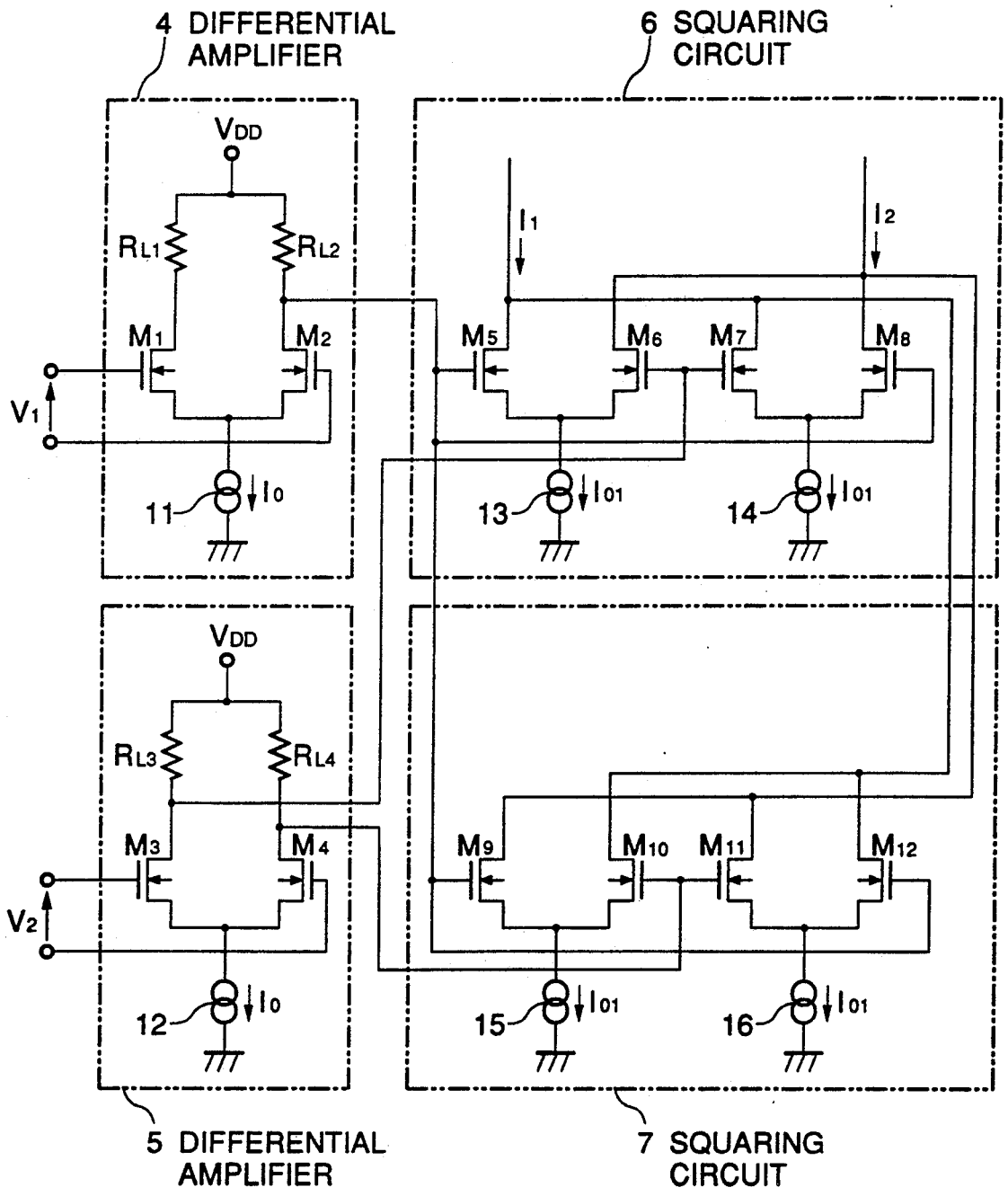
FIG. 5 is a circuit diagram of one embodiment of the analog multiplier in accordance with the present invention.

Referring to FIG. 5, there is shown a detailed circuit diagram of a second embodiment of the multiplier in accordance with the present invention.

In the circuit shown in FIG. 5, the first input signal $V_1$ is applied to a first differential amplifier circuit 4, which includes a pair of transistors $M_1$ and $M_2$ having their sources connected to each other. More specifically, the first input signal $V_1$ is applied between gates of the transitors $M_1$ and $M_2$. The first differential amplifier circuit 4 also includes a constant current source 11 ($I_0$) connected between the common-connected sources of the transistors $M_1$ and $M_2$ and ground, and resistors $R_{L1}$ and $R_{L2}$ connected between a high voltage supply voltage $V_{DD}$ and drains of the transistors $M_1$ and $M_2$, respectively.

On the other hand, the second input signal $V_2$ is applied to a second differential amplifier circuit 5, which includes a pair of transistors $M_3$ and $M_4$ having their sources connected to each other. More specifically, the second input signal $V_2$ is applied between gates of the transistors $M_3$ and $M_4$. The second differential amplifier circuit 5 also includes a constant current source 12 ($I_0$) connected between the ground and the common-connected sources of the transistors $M_3$ and $M_4$, and resistors $R_{L3}$ and $R_{L4}$ connected between the high voltage supply voltage $V_{DD}$ and drains of the transistors $M_3$ and $M_4$, respectively.

A non-inverted output of the first differential amplifier circuit 4 is connected to a first input of each of a first squaring circuit 6 and a second squaring circuit 7. A non-inverted output of the second differential amplifier circuit 5 is connected to a second input of the second squaring circuit 7. On the other hand, an inverted output of the second differential amplifier circuit 5 is connected to a second input of the first squaring circuit 6.

The first squaring circuit 6 includes two pairs of transistors $M_5$ and $M_6$ and $M_7$ and $M_8$, each pair constituting an unbalanced differential transistor pair having common-connected sources. The first squaring circuit 6 also includes a constant current source 13 ($I_{01}$) connected between the ground and the common-connected sources of the transistors $M_5$ and $M_6$, and another constant current source 14 ($I_{01}$) connected between the ground and the common-connected sources of the transistors $M_7$ and $M_8$. Drains of the transistors $M_5$ and $M_7$ are connected to each other, and drains of the transistors $M_6$ and $M_8$ are connected to each other. In addition, gates of the transistors $M_5$ and $M_8$ are connected to each other, and gates of the transistors $M_6$ and $M_7$ are connected to each other. The gates of the transistors $M_5$ and $M_8$ are connected to receive the non-inverted output of the first differential amplifier circuit 4, and the gates of the transistors $M_6$ and $M_7$ are connected to receive the inverted output of the second differential amplifier circuit 5.

The second squaring circuit 7 includes two pairs of transistors $M_9$ and $M_{10}$ and $M_{11}$ and $M_{12}$, each pair constituting an unbalanced differential transistor pair having common-connected sources. The second squaring circuit 7 also includes a constant current source 15 ($I_{01}$) connected between the ground and the common-connected sources of the transistors $M_9$ and $M_{10}$, and another constant current source 16 ($I_{01}$) connected between the ground and the common-connected sources of the transistors $M_{11}$ and $M_{12}$. Drains of the transistors $M_9$ and $M_{11}$ are connected to each other, and drains of the transistors $M_{10}$ and $M_{12}$ are connected to each other. In addition, gates of the transistors $M_9$ and $M_{12}$ are connected to each other, and gates of the transistors $M_{10}$ and $M_{11}$ are connected to each other. The gates of the transistors $M_9$ and $M_{12}$ are connected to receive the non-inverted output of the first differential amplifier circuit 4, and the gates of the transistors $M_{10}$ and $M_{11}$ are connected to receive the non-inverted output of the second differential amplifier circuit 5.

Outputs of the two squaring circuits 6 and 7 are connected to each other in an inverted phase. Namely, the drains of the transistors $M_5$, $M_7$, $M_{10}$ and $M_{12}$ are connected in common, and the drains of the transistors $M_6$, $M_8$, $M_9$ and $M_{11}$ are connected in common.

Now, operation of the above mentioned multiplier will be described.

First, assume that gate widths of the transistors $M_1$, $M_2$, $M_3$ and $M_4$ are $W_1$, $W_2$, $W_3$ and $W_4$, respectively, and gate lengths of the transistors $M_1$, $M_2$, $M_3$ and $M_4$ are $L_1$, $L_2$, $L_3$ and $L_4$, respectively. The gate widths and the gates lengths of the transistors $M_1$, $M_2$, $M_3$ and $M_4$ are set as follows:

$$\frac{W_1}{L_1}=\frac{W_2}{L_2}=\frac{W_3}{L_3}=\frac{W_4}{L_4} \quad (42)$$

In addition, by expressing a mobility of the transistors by $\mu_n$ and a thickness of a gate oxide film by Cox, a factor $\alpha_1$ is defined as follows:

$$\alpha_1=\mu_n\frac{Cox}{2}\frac{W_1}{L_1} \quad (43)$$

Furthermore, assume that a threshold voltage of the transistors $M_1$, $M_2$, $M_3$ and $M_4$ is $V_t$, and gate-to-source voltages of the transistors $M_1$, $M_2$, $M_3$ and $M_4$ are $V_{gs1}$, $V_{gs2}$, $V_{gs3}$ and $V_{gs4}$, respectively. Under these conditions, drain currents $I_{d1}$, $I_{d2}$, $I_{d3}$ and $I_{d4}$ of the transistors $M_1$, $M_2$, $M_3$ and $M_4$ are expressed as follows:

$$I_{d1}=\alpha_1(V_{gs1}-V_t)^2 \quad (44)$$

$$I_{d2}=\alpha_1(V_{gs2}-V_t)^2 \quad (45)$$

$$I_{d3}=\alpha_1(V_{gs3}-V_t)^2 \quad (46)$$

$$I_{d4}=\alpha_1(V_{gs4}-V_t)^2 \quad (47)$$

Here, the drain currents $I_{d1}$, $I_{d2}$, $I_{d3}$ and $I_{d4}$ and the gate-to-source voltages $V_{gs1}$, $V_{gs2}$, $V_{gs3}$ and $V_{gs4}$ have the relation expressed by the following equations:

$$I_{d1}+I_{d2}=I_0 \quad (48)$$

$$I_{d3}+I_{d4}=I_0 \quad (49)$$

$$V_{gs1} - V_{gs2} = V_1 \quad (50)$$

$$V_{gs3} - V_{gs4} = V_2 \quad (51)$$

From the equations (44) to (51), an equation indicating a transfer curve of a differential MOS transistor pair can be obtained as follows:

$$I_{d1} - I_{d2} = \alpha_1 V_1 \sqrt{\frac{2I_0}{\alpha_1} - V_1^2} \quad (52)$$

$$I_{d3} - I_{d4} = \alpha_1 V_2 \sqrt{\frac{2I_0}{\alpha_1} - V_2^2} \quad (53)$$

Therefore, assuming that the values of all the resistors $R_{L1}$, $R_{L2}$, $R_{L3}$ and $R_{L4}$ are equal to each other and expressed by $R_L$, an input voltage $\Delta V_{IN1}$ applied to the first squaring circuit 6 composed of the transistors $M_5$, $M_6$, $M_7$ and $M_8$ is expressed by the following equation (54).

$$\Delta V_{IN1} = (V_{DD} - R_L \cdot I_{d2}) - (V_{DD} - R_L \cdot I_{d3}) = R_L \cdot (I_{d3} - I_{d2}) \quad (54)$$

Similarly, an input voltage $\Delta V_{IN2}$ applied to the second squaring circuit 7 composed of the transistors $M_9$, $M_{10}$, $M_{11}$ and $M_{12}$ is expressed as follows:

$$\Delta V_{IN2} = (V_{DD} - R_L \cdot I_{d2}) - (V_{DD} - R_L \cdot I_{d4}) = R_L \cdot (I_{d4} - I_{d2}) \quad (55)$$

Next, explanation will be made about the fact that the circuit composed of the transistors $M_5$, $M_6$, $M_7$ and $M_8$ functions as a squaring circuit.

First, assume that gate widths of the transistors $M_5$, $M_6$, $M_7$ and $M_8$ are $W_5$, $W_6$, $W_7$ and $W_8$, respectively, and gate lengths of the transistors $M_5$, $M_6$, $M_7$ and $M_8$ are $L_5$, $L_6$, $L_7$ and $L_8$, respectively. The gate widths and the gates lengths of the transistors $M_5$, $M_6$, $M_7$ and $M_8$ are set to fulfil the following condition:

$$\frac{W_6/L_6}{W_5/L_5} = \frac{W_8/L_8}{W_7/L_7} = k\ (>1) \quad (56)$$

On the other hand, $\alpha_2$ is defined as follows:

$$\alpha_2 = \mu_n \frac{Cox}{2} \frac{W_5}{L_5} \quad (57)$$

In addition, assume that a threshold voltage of the transistors $M_5$, $_6$, $M_7$ and $M_8$ is $V_t$, and gate-to-source voltages of the transistors $M_5$, $M_6$, $M_7$ and $M_8$ are $V_{gs5}$, $V_{gs6}$, $V_{gs7}$ and $V_{gs8}$, respectively. Under these conditions, drain currents $I_{d5}$, $I_{d6}$, $I_{d7}$ and $I_{d8}$ of the transistors $M_5$, $M_6$, $M_7$ and $M_8$ can be expressed as follows:

$$I_{d5} = \alpha_2 (V_{gs5} - V_t)^2 \quad (58)$$

$$I_{d6} = k\alpha_2 (V_{gs6} - V_t)^2 \quad (59)$$

$$I_{d7} = \alpha_2 (V_{gs7} - V_t)^2 \quad (60)$$

$$I_{d8} = k\alpha_2 (V_{gs8} - V_t)^2 \quad (61)$$

Here, the drain currents $I_{d5}$, $I_{d6}$, $I_{d7}$ and $I_{d8}$ and the gate-to-source voltages $V_{gs5}$, $V_{gs6}$, $V_{gs7}$ and $V_{gs8}$ have the relation expressed by the following equations (62) to (64):

$$I_{d5} + I_{d6} = I_{01} \quad (62)$$

$$I_{d7} + I_{d8} = I_{01} \quad (63)$$

$$V_{gs5} - V_{gs6} = V_{gs8} - V_{gs7} = \Delta V_{IN1} \quad (64)$$

From the equations (58) to (64), the following equation can be derived:

$$I_{d5} - I_{d6} = \frac{1}{\left(1 + \frac{1}{k}\right)^2} \left[ -\left(1 - \frac{1}{k}\right)\left\{\left(1 + \frac{1}{k}\right) I_{01} - 2\alpha_1 (\Delta V_{IN1})^2\right\} + 4\alpha_2 (\Delta V_{IN1}) \frac{1}{\sqrt{k}} \sqrt{\left(1 + \frac{1}{k}\right)\frac{I_{01}}{\alpha_2} - (\Delta V_{IN1})^2} \right] \quad (65)$$

$$I_{d7} - I_{d8} = \frac{1}{\left(1 + \frac{1}{k}\right)^2} \left[ -\left(1 - \frac{1}{k}\right)\left\{\left(1 + \frac{1}{k}\right) I_{01} - 2\alpha_1 (\Delta V_{IN1})^2\right\} - 4\alpha_2 (\Delta V_{IN1}) \frac{1}{\sqrt{k}} \sqrt{\left(1 + \frac{1}{k}\right)\frac{I_{01}}{\alpha_2} - (\Delta V_{IN1})^2} \right] \quad (66)$$

Accordingly, a differential output current $(Ip - Iq)_1$ of the squaring circuit 6 can be obtained as follows:

$$\begin{aligned}(I_p - I_q)_1 &= (I_{d5} + I_{d7}) - (I_{d6} + I_{d8}) \\ &= (I_{d5} - I_{d6}) + (I_{d7} - I_{d8}) \\ &= -\frac{2}{\left(1 + \frac{1}{k}\right)^2}\left(1 - \frac{1}{k}\right) \\ &\quad \left\{\left(1 + \frac{1}{k}\right) I_{01} - 2\alpha_2 (\Delta V_{IN1})^2\right\}\end{aligned} \quad (67)$$

It will be seen from the equation (67) that the differential output current is in proportion to a square of the input voltage $\Delta V_{IN1}$. Similarly, a differential output current $(Ip - Iq)_2$ of the squaring circuit 7 formed of the transistors $M_9$, $M_{10}$, $M_{11}$ and $M_{12}$ can be obtained as follows:

$$\begin{aligned}(I_p - I_q)_2 &= (I_{d9} + I_{d11}) - (I_{d10} + I_{d12}) \\ &= (I_{d9} - I_{d10}) + (I_{d11} - I_{d12}) \\ &= -\frac{2}{\left(1 + \frac{1}{k}\right)^2}\left(1 - \frac{1}{k}\right)\end{aligned} \quad (68)$$

-continued $$\left\{\left(1+\frac{1}{k}\right)I_{01}-2\alpha_2(\Delta V_{IN2})^2\right\}$$

As mentioned hereinbefore, since the differential output currents $(Ip-Iq)_1$ and $(Ip-Iq)_2$ of the squaring circuits 6 and 7 are summed in an inverted phase or polarity to each other, a different output current $\Delta Io$ is expressed as follows:

$$\begin{aligned}\Delta I_0 &= I_1 - I_2 \\ &= (I_p - I_q)_2 - (I_p - I_q)_2\end{aligned} \tag{69}$$

$$= -\frac{2\left(1-\frac{1}{k}\right)\left\{\left(1+\frac{1}{k}\right)I_{01}-2\alpha_2(\Delta V_{IN1})^2\right\}}{\left(1+\frac{1}{k}\right)^2} + \frac{2\left(1-\frac{1}{k}\right)\left\{\left(1+\frac{1}{k}\right)I_{01}-2\alpha_2(\Delta V_{IN2})^2\right\}}{\left(1+\frac{1}{k}\right)^2}$$

$$= \frac{2\left(1-\frac{1}{k}\right)}{\left(1+\frac{1}{k}\right)^2}2\alpha_2\{(\Delta V_{IN1})^2-(\Delta V_{IN2})^2\}$$

Here, if this equation (69) is substituted with the equations (54) and (55), the following equation (70) can be obtained.

$$\Delta I_0 = \frac{2\left(1-\frac{1}{k}\right)}{\left(1+\frac{1}{k}\right)^2}2\alpha_2[\{R_L(I_{d3}-I_{d2})\}^2-\{R_L(I_{d4}-I_{d2})\}^2] \tag{70}$$

$$= \frac{4\alpha_2 R_L^2\left(1-\frac{1}{k}\right)}{\left(1+\frac{1}{k}\right)^2}(I_{d3}-I_{d4})(I_{d3}+I_{d4}-2I_{d2})$$

In addition, if the equation (49) is substituted into the equation (70), the following equation (71) can be obtained:

$$\Delta I_0 = \frac{4\alpha_2 R_L^2\left(1-\frac{1}{k}\right)}{\left(1+\frac{1}{k}\right)^2}(I_{d3}-I_{d4})(I_0-2I_{d2}) \tag{71}$$

Furthermore, if the equation (48) is substituted into the equation (71), the following equation (72) can be obtained:

$$\Delta I_0 = \frac{4\alpha_2 R_L^2\left(1-\frac{1}{k}\right)}{\left(1+\frac{1}{k}\right)^2}(I_{d3}-I_{d4})(I_{d1}-I_{d2}) \tag{72}$$

In addition, if the equations (52) and (53) are substituted into the equation (72), the following equation (73) can be obtained:

$$\Delta I_0 = \frac{4\alpha_2 R_L^2\left(1-\frac{1}{k}\right)}{\left(1+\frac{1}{k}\right)^2}\left(\alpha_1 V_1\sqrt{\frac{2I_0}{\alpha_1}-V_1^2}\right)\left(\alpha_1 V_2\sqrt{\frac{2I_0}{\alpha_1}-V_2^2}\right) \tag{73}$$

It will be seen from this equation (73) that the differential output current $\Delta Vo$ includes a product of the input first voltage $V_1$ and the second input voltage $V_2$ by the transfer curves of the two differential MOS transistor pair, and is in proportion to the product of the input first voltage $V_1$ and the second input voltage $V_2$ if the input first voltage $V_1$ and the second input voltage $V_2$ are small. Namely, the shown circuit has a multiplication characteristics.

This could be understood from the fact that the equation (69) can be simplified to the following equation (74) by substituting $\Delta V_{IN1}=V_X+V_Y$ and $\Delta V_{IN2}=V_X-V_Y$ to the equation.

$$\Delta I_0 = \frac{16\alpha_2\left(1-\frac{1}{k}\right)}{\left(1+\frac{1}{k}\right)^2}V_X V_Y \tag{74}$$

It would be understood from the equation (74) that the circuit shown in FIG. 5 has the multiplier characteristics Furthermore, the equation (73) can be modified as follows:

$$\Delta I_0 = \frac{4\alpha_2 R_L^2\left(1-\frac{1}{k}\right)}{\left(1+\frac{1}{k}\right)^2}\alpha_1^2 V_1 V_2 \sqrt{\frac{4I_0^2}{\alpha_1^2}-\frac{2I_0}{\alpha_1}(V_1^2+V_2^2)+V_1^2V_2^2} \tag{75}$$

Here, the items of $V_1^2$ and $V_2^2$ are neglected, the following equation (76) can be obtained $$\Delta I_0 \approx \frac{8\alpha_1\alpha_2 I_0 R_L^2\left(1-\frac{1}{k}\right)}{\left(1+\frac{1}{k}\right)^2} V_1 V_2 \quad (76)$$

It is also understood from the equation (76) that the shown circuit has the multiplier characteristics.

The inventor conducted simulation of the multiplier shown in FIG. 5 under the condition of $R_L=10K\Omega$, $I_0=100\ \mu A$, $I_{01}=100\ \mu A$, $W_1=20\ \mu m$, $L_1=5\ \mu m$, $W_5=10\ \mu m$, $L_5=5\ \mu m$, $k=5$, $Tox=320\ \mathring{A}$. The result of the simulation is shown in FIG. 6.

Figure 6:
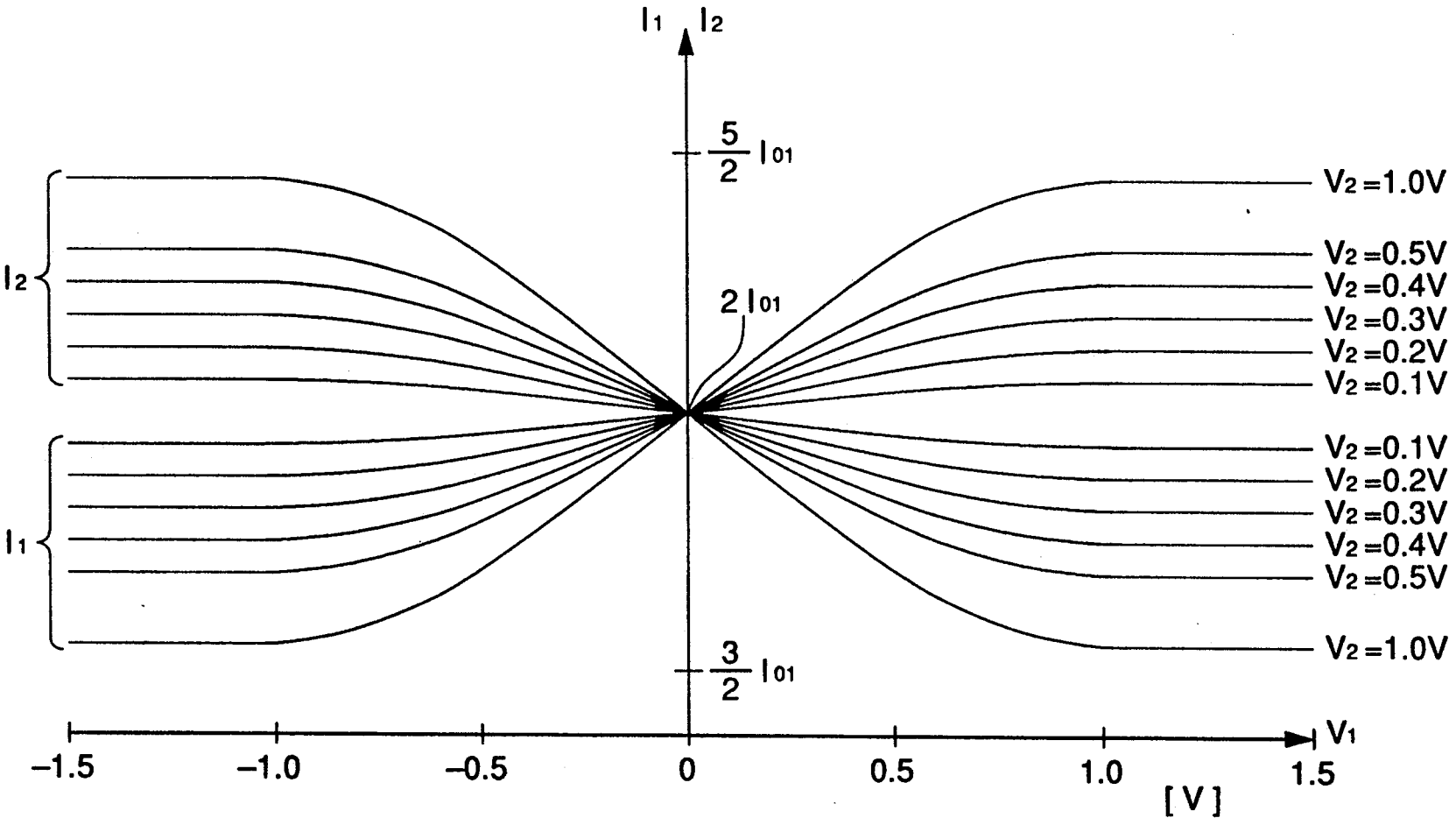
FIG. 6 is shown a graph illustrating the result of simulation of the characteristics of the multiplier shown in FIG. 5.

It would be understood from FIG. 6 that the multiplier in accordance with the present invention can considerably improve the linearity of the circuit in comparison with the conventional ones.

In addition, since the shown embodiment has no unbalance in circuit structure fo the pair of input voltages $V_1$ and $V_2$, even if the input voltages $V_1$ and $V_2$ are exchanged, the same characteristics can be obtained.

As seen from the above, the multiplier in accordance with the present invention includes two squaring circuits each of which is composed of a pair of unbalanced differential circuits, so that the first and second input signals are supplied to the pair of unbalanced differential circuits as a differential input signal. Therefore, no unbalance in the circuit structure exists for the two input signals, so that the multiplier characteristics for the first input signal is the same as the multiplier characteristics for the second input signal. As a result, a multiplier having an excellent linearity and a wide dynamic range can be executed.

The invention has thus been shown and described with reference to the specific embodiments. However, it should be noted that the present invention is in no way limited to the details of the illustrated structures but changes and modifications may be made within the scope of the appended claims.

I claim:

1. A multiplier comprising:

a first squaring circuit including first and second transistors having a first gate width-to-gate length ratio and having their drains connected to each other, and third and fourth transistors having their drains connected to each other and having a second gate width-to-gate length ratio different from said first gate width-to-gate length ratio, gates of said first and fourth transistors being connected to each other and connected in common to receive a first input signal, and gates of said second and third transistors being connected to each other and connected in common to receive an inverted signal of a second input signal, sources of said first and third transistors being connected to each other and sources of said second and fourth transistors being connected to each other, so that two sets of unbalanced differential circuits are formed, and a squared value of a difference between said first input signal and said inverted signal of said second input signal is outputted;

a second squaring circuit including fifth and sixth transistors having a third gate width-to-gate length ratio and having their drains connected to each other, and seventh and eighth transistors having their drains connected to each other and having a fourth gate width-to-gate length ratio different from said third gate width-to-gate length ratio, gates of said fifth and eighth transistors being connected to each other and connected in common to receive said first input signal, and gates of said sixth and seventh transistors being connected to each other and connected in common to receive said second input signal, sources of said fifth and seventh transistors being connected to each other and sources of said sixth and eighth transistors being connected to each other, so that two sets of unbalanced differential circuits are formed, and a squared value of a difference between said first input signal and said second input signal is outputted; and a subtracting circuit receiving said outputs of said first and second squaring circuit for subtracting said output of said second squaring circuit from said output of said first squaring circuit.

2. A multiplier claimed in claim 1 further including a first differential amplifier connected to receive said first input signal and for outputting said first input signal to the gates of the first, fourth, fifth and eighth transistors, and a second differential amplifier connected to receive said second input signal and for outputting said second input signal to the gates of said sixth and seventh transistors, and said inverted input signal to the gates of said second and third transistors.

3. A multiplier comprising:

a first squaring circuit including first and second transistors having a first gate width-to-gate length ratio and having their drains connected to each other, and third and fourth transistors having their drains connected to each other and having a second gate width-to-gate length ratio different from said first gate width-to-gate length ratio, gates of said first and fourth transistors being connected to each other and connected in common to receive a first input signal, and gates of said second and third transistors being connected to each other and connected in common to receive an inverted signal of a second input signal, sources of said first and third transistors being connected to each other and sources of said second and fourth transistors being connected to each other, so that two sets of unbalanced differential circuits are formed, and a squared value of a difference between said first input signal and said inverted signal of said second input signal is outputted; and a second squaring circuit including fifth and sixth transistors having a third gate width-to-gate length ratio and having their drains connected to each other, and seventh and eighth transistors having their drains connected to each other and having a fourth gate width-to-gate length ratio different from said third gate width-to-gate length ratio, gates of said fifth and eighth transistors being connected to each other and connected in common to receive said first input signal, and gates of said sixth and seventh transistors being connected to each other and connected in common to receive said second input signal, sources of said fifth and seventh transistors being connected to each other and sources of said sixth and eighth transistors being connected to each other, so that two sets of unbalanced differential circuits are formed, and a squared value of a difference between said first input signal and said second input signal is outputted; and the drains of said first, second, fifth and sixth transistors being connected to each other and also connected in common to receive a first drain current, and the drains of said third, fourth, seventh and eighth transistors being connected to each other and also connected in common to receive a second drain current, so that a difference between said first and second drain currents indicates a multiplication of said first and second input signals.

4. A multiplier claimed in claim 3 further including a first differential amplifier connected to receive said first input signal and for outputting said first input signal to the gates of the first, fourth, fifth and eighth transistors, and a second differential amplifier connected to receive said second input signal and for outputting said second input signal to the gates of said sixth and seventh transistors, and said inverted input signal to the gates of said second and third transistors.

* * * * *